US011387056B2

(12) United States Patent
Chen

(10) Patent No.: US 11,387,056 B2
(45) Date of Patent: Jul. 12, 2022

(54) KEY PRELOADING STRUCTURE AND ASSEMBLY METHOD THEREOF

(71) Applicant: BENQ CORPORATION, Taipei (TW)

(72) Inventor: Chih-Ming Chen, Taipei (TW)

(73) Assignee: BenQ Corporation, Taipei (TW)

( * ) Notice: Subject to any disclaimer, the term of this patent is extended or adjusted under 35 U.S.C. 154(b) by 0 days.

(21) Appl. No.: 16/950,971

(22) Filed: Nov. 18, 2020

(65) Prior Publication Data

US 2021/0193412 A1 Jun. 24, 2021

(30) Foreign Application Priority Data

Dec. 19, 2019 (CN) ..... 201911315482.9

(51) Int. Cl.
*H01H 21/24* (2006.01)
*H01H 11/00* (2006.01)
*H01H 21/04* (2006.01)

(52) U.S. Cl.
CPC ..... *H01H 21/24* (2013.01); *H01H 11/005* (2013.01); *H01H 21/04* (2013.01); *H01H 2227/032* (2013.01); *H01H 2233/058* (2013.01); *H01H 2235/016* (2013.01)

(58) Field of Classification Search
CPC ..... H01H 21/24; H01H 11/005; H01H 21/04; H01H 2227/032; H01H 2233/058; H01H 2235/016; H01H 13/705; H01H 2221/064; H01H 13/88; H01H 11/00; G06F 3/0202
USPC ..... 200/343, 339, 553, 557
See application file for complete search history.

(56) References Cited

U.S. PATENT DOCUMENTS

| | | | | |
|---|---|---|---|---|
| 9,589,749 | B1 | 3/2017 | Wu | |
| 10,579,147 | B2 * | 3/2020 | Wang | G06F 3/03543 |
| 10,698,499 | B1 * | 6/2020 | Chang | G06F 3/03543 |
| 2017/0277275 | A1 * | 9/2017 | Chao | G06F 3/0202 |
| 2018/0006648 | A1 | 1/2018 | Liu | |
| 2018/0017989 | A1 | 1/2018 | Tamura et al. | |

FOREIGN PATENT DOCUMENTS

| | | | |
|---|---|---|---|
| KR | 20190108544 | A | 9/2019 |
| TW | M560620 | U | 5/2018 |

OTHER PUBLICATIONS

Office action of counterpart application by Taiwan IP Office dated Jul. 6, 2020.
Office action of counterpart application EPO dated Apr. 26, 2021.

* cited by examiner

*Primary Examiner* — Lheiren Mae A Caroc

(57) ABSTRACT

A key preloading structure including a base, a set of switches and a set of keys is provided. The set of switches is arranged on the base. The set of keys has a rotating shaft and two actuators. The rotating shaft is assembled on the base. One end of each actuator is fixedly connected to the rotating shaft, and another end is disposed on a switch of the set of switches. Each of the two actuators preloads the set of switches with a force less than a triggering force for starting the set of switches.

10 Claims, 4 Drawing Sheets

KEY PRELOADING STRUCTURE AND ASSEMBLY METHOD THEREOF

This application claims the benefit of People's Republic of China application Serial No. 201911315482.9, filed Dec. 19, 2019, the subject matter of which is incorporated herein by reference.

BACKGROUND OF THE INVENTION

Field of the Invention

The invention relates in general to a key, and more particularly to a key preloading structure and an assembly method thereof.

Description of the Related Art

To assure the overall consistency, aesthetics and functional needs, the size of the keys is increased in some electronic products, such as mouse. Since the keys have a large size and are integrally formed in one piece with the housing, the pressed feel of the keys differs widely and is hard to assure, and problems such as dead zone and virtual press may easily arise when pressing the keys.

SUMMARY OF THE INVENTION

The invention is directed to a key preloading structure and an assembly method thereof. The set of keys preloads the set of switches with a force less than a triggering force for starting the set of switches. During the assembly process, the set of keys remains in contact with the set of switches and will not generate any extra clearance, hence resolving the virtual press problem which occurs when pressing the keys.

According to a first aspect of the present invention, a key preloading structure including a base, a set of switches and a set of keys is provided. The set of switches is arranged on the base. The set of keys has a rotating shaft and two actuators. The rotating shaft is assembled on the base. One end of each actuator is fixedly connected to the rotating shaft, and another end is disposed on the set of switches. Each of the actuators preloads the set of switches with a force less than a triggering force for starting the set of switches.

According to a second aspect of the present invention, a key assembly method used in a key preloading structure is provided. The key preloading structure includes a base, a set of switches and a set of keys. The set of keys has a rotating shaft and two actuators. The key assembly method includes the following steps. The rotating shaft is assembled on the base, wherein the rotation of the rotating shaft is restricted by a detachable component. One end of each actuator is temporarily connected to the rotating shaft, and another end is disposed on the set of switches, wherein each of the two actuators preloads the set of switches with a force less than a triggering force for starting the set of switches. One end of each actuator is fixedly connected to the rotating shaft, and the detachable component is detached.

The above and other aspects of the invention will become better understood with regard to the following detailed description of the preferred but non-limiting embodiment(s). The following description is made with reference to the accompanying drawings.

DETAILED DESCRIPTION OF THE INVENTION

Detailed descriptions of the invention are disclosed below with a number of embodiments. However, the disclosed embodiments are for explanatory and exemplary purposes only, not for limiting the scope of protection of the invention. Similar/identical designations are used to indicate similar/identical elements. Directional terms such as above, under, left, right, front or back are used in the following embodiments to indicate the directions of the accompanying drawings, not for limiting the present invention.

Figure 1:
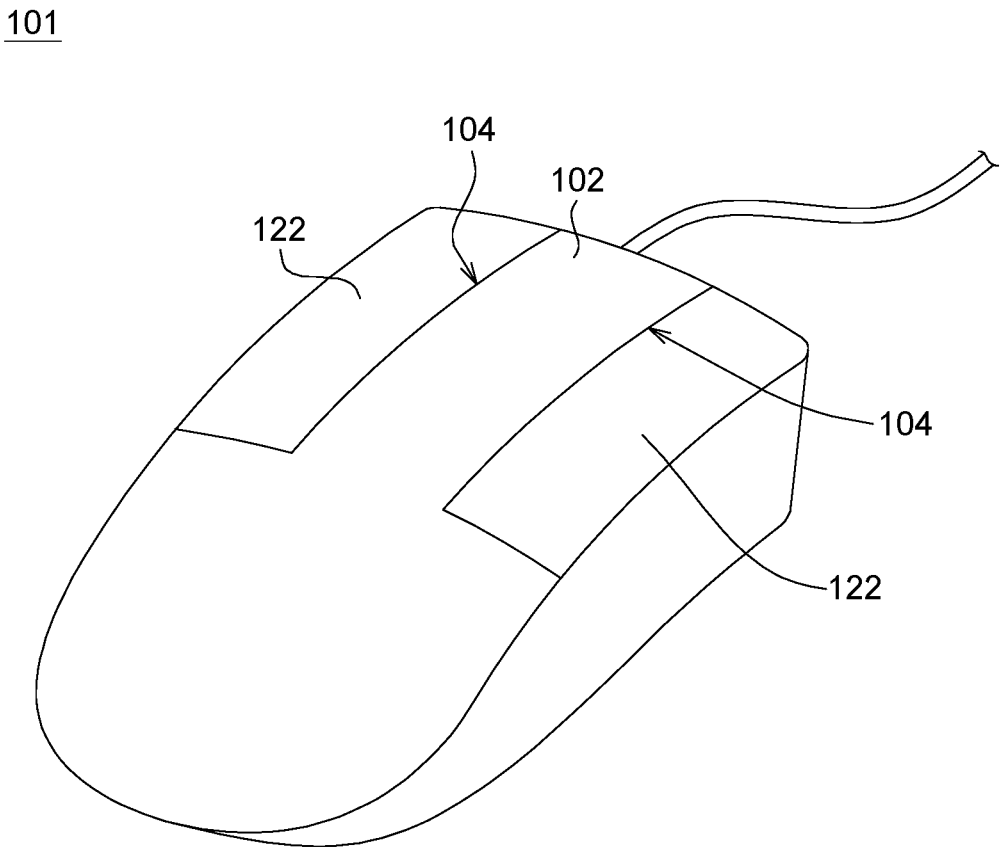
FIG. 1 is a schematic diagram of a mouse according to an embodiment of the present invention.
Figure 2A:
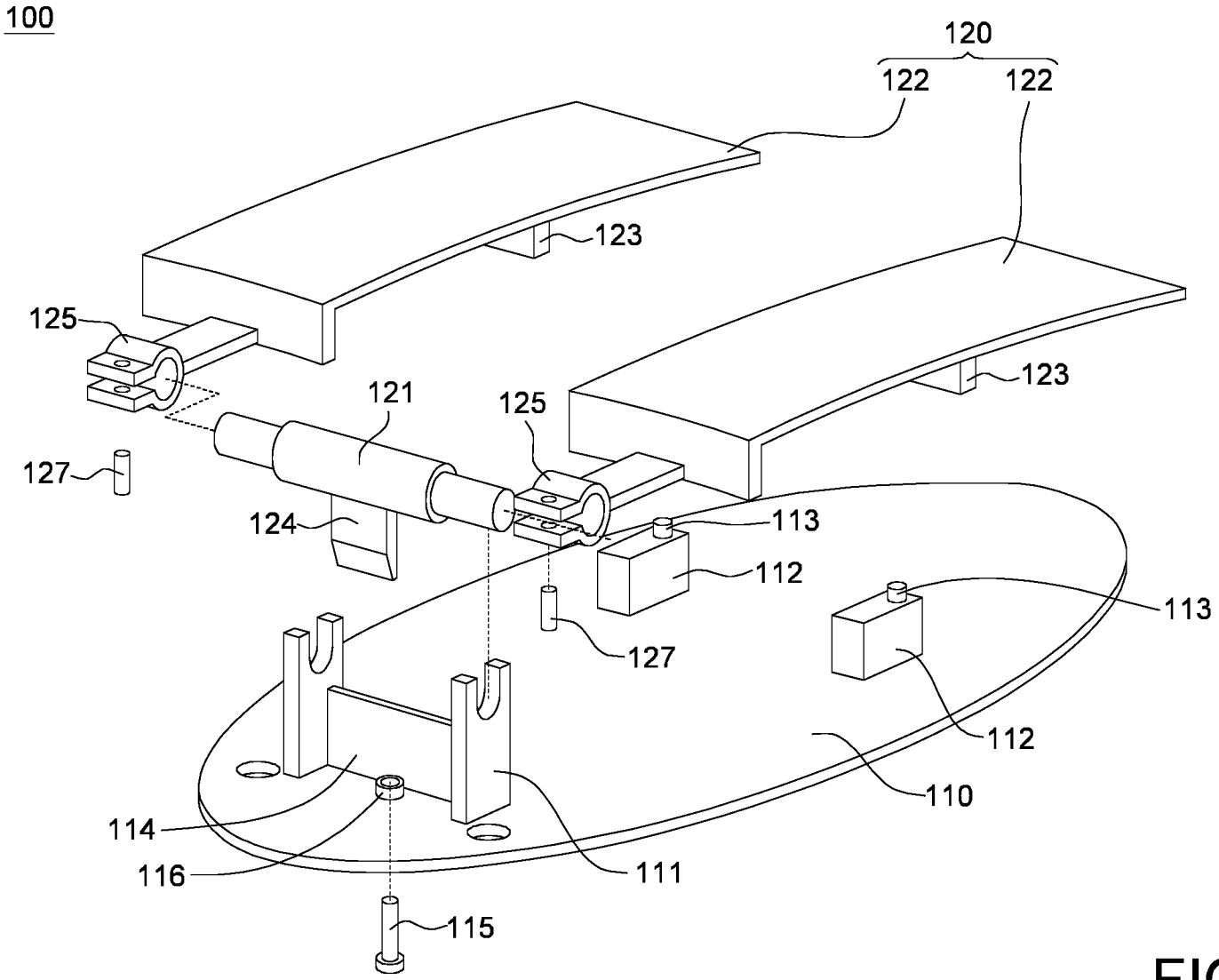
FIG. 2A is an explosion diagram of a key preloading structure according to an embodiment of the present invention.
Figure 2B:
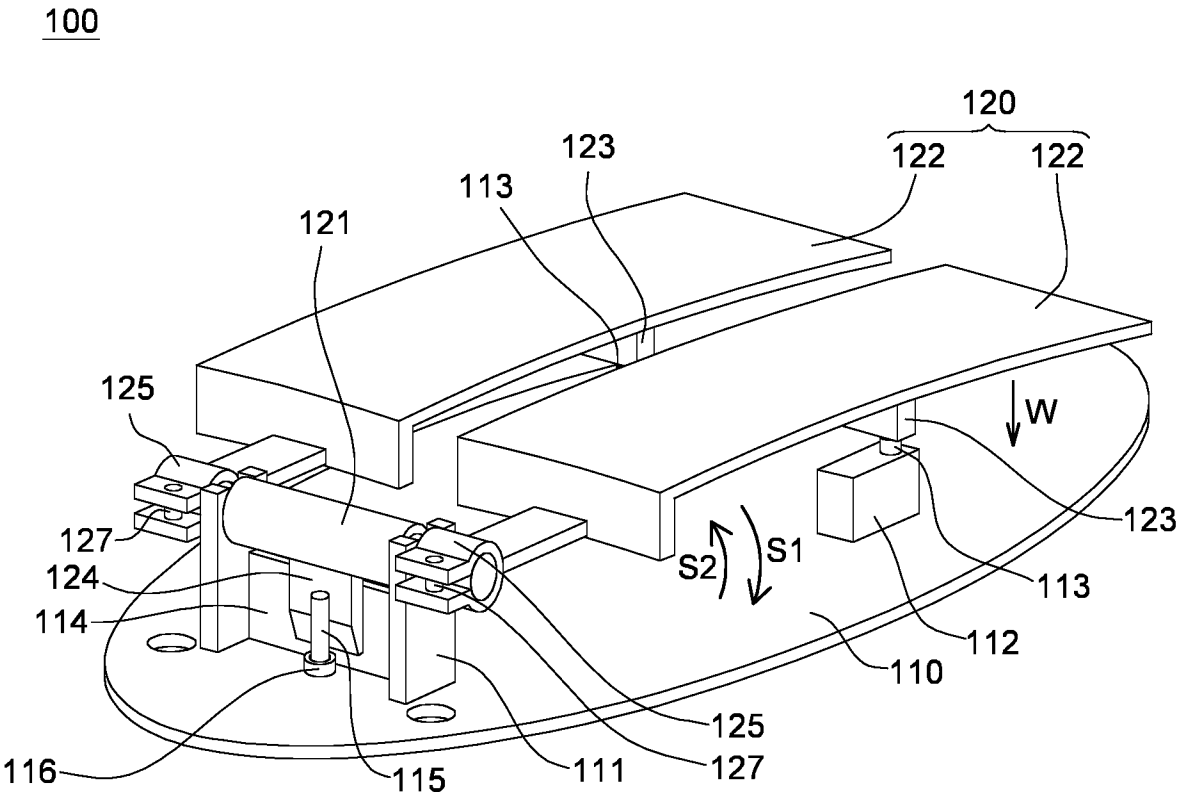
FIG. 2B is a schematic 3D diagram of a key preloading structure according to an embodiment of the present invention.

According to an embodiment of the present invention, a key preloading structure and an assembly method thereof used in a mouse are provided, for example. Refer to FIG. 1, 2A and 2B. FIG. 1 is a schematic diagram of a mouse 101 according to an embodiment of the present invention. FIG. 2A is an explosion diagram of a key preloading structure 100 according to an embodiment of the present invention. FIG. 2B is a schematic 3D diagram of a key preloading structure 100 according to an embodiment of the present invention.

The key preloading structure 100 includes a base 110, a set of switches 112 and a set of keys 120. The set of switches 112 is arranged on the base 110. The set of keys 120 has a rotating shaft 121 and two actuators 122 (that is, the left key and the right key). The rotating shaft 121 is assembled on the base 110 (that is, the fixed frame 111 of the base 110). One end of each actuator 122 is fixedly connected to the rotating shaft 121, and another end of each actuator 122 is disposed on the set of switches 112. The two actuators 122 preload the set of switches 112 with a force W less than a triggering force for starting the set of switches 112. The force W is mainly generated by the actuators 122 but can be changed to fit actual needs through the selection of material or the thickness of the actuators 122. Besides, the key preloading structure 100 may further include a housing 102 (referring to FIG. 1) disposed opposite to the base 110. The housing 102 has an opening 104 in which the two actuators 122 are arranged.

Let the mouse 101 be used as an embodiment. A set of mechanical fretting switches 112 is disposed under the set of keys 120 of the mouse 101. When a key (that is, an actuator 122) of the mouse 101 is pressed downwards, a metal reed 113 of the set of mechanical fretting switches 112 will trigger the contact underneath to complete a click operation. In an embodiment, the triggering force for moving the metal reed 113 of the set of switches 112 downwards is such as 50 g or above, but the invention is not limited thereto.

Moreover, the mouse 101 can be an optical mouse, and the housing 102 may further include a receiver (not illustrated) and a light source module (not illustrated) disposed therein. The light source module is arranged on the base 110. When the receiver receives a light from the light source module, this indicates that the user operates the mouse to perform a click operation. In an embodiment, the force W preloaded on the metal reed 113 of the set of switches 112 by each actuator 122 is less than a triggering force (W<50 g) and is such as in a range of 10 g-20 g, but the invention is not limited thereto. When the preloaded force W of each actuator 122 is less than the triggering force for moving the metal reed 113 of the set of switches 112 downwards, the metal reed 113 of the set of switches 112 will not contact the contact underneath, and the receiver will not receive the light from the light source module. This indicates that the user does not operate the mouse to perform a click operation.

In an embodiment, the set of switches 112 includes a set of force sensing elements or a set of thin-film switch elements, respectively configured for generating a pressing signal. The force sensing elements can be realized by mechanical, piezoelectric, capacitive or resistance inductive force sensors. The thin-film switch element includes an upper circuit board and a lower circuit board. When the user's finger presses the thin-film switch element, the contacts of the upper circuit board and the lower circuit board are pressed and become electrically connected. Conversely, when the user's finger is off the thin-film switch element, the contacts of the upper circuit board and the lower circuit board rebound and make the contacts of the upper circuit board and the lower circuit board break away.

Refer to FIGS. 2A and 2B. One end of the two actuators 122 connected to the rotating shaft 121 has two shaft sleeves 125, that is, the left shaft sleeve and the right shaft sleeve in which the rotating shaft 121 can be mounted. During the assembly process, firstly, the two ends of the rotating shaft 121 are temporarily mounted in the two shaft sleeves 125 of the actuators 122; then, a locking member 127, such as a screw rod, passes through each of the shaft sleeves 125 to fix the shaft sleeves 125 on the rotating shaft 121. In another embodiment, the shaft sleeves 125 can be fixed on the rotating shaft 121 using other method (engagement, adhering or clamping), such that the shaft sleeves 125 and the rotating shaft 121 are fixedly connected and can rotate synchronously.

Refer to FIGS. 2A and 2B. The two actuators 122 have two protrusions 123 facing and correspondingly contacting the top surfaces of the set of switches 112 (or the metal reeds 113). That is, the two actuators 122 preload a force W on the set of switches 112 to provide a pressed feel and preloaded force. Therefore, the key preloading structure 100 of the present embodiment can resolve the conventional problems of the pressed feel of the keys differing widely and being hard to assure, and avoid dead zone and virtual press which may easily arise when pressing the keys.

Refer to FIG. 2A and 2B. The rotating shaft 121 has a limiting piece 124 facing the base 110. When the limiting piece 124 and a stopping plate 114 of the base 110 (that is, the fixed frame 111) contact each other, the two actuators 122 preload a force W on the set of switches 112. Therefore, during the assembly process, the two actuators 122 can be positioned when the limiting piece 124 and the stopping plate 114 contact each other, such that the two actuators 122 and the set of switches 112 remain to be in contact with each other and will not generate extra clearance.

Refer to FIG. 2B. When the two actuators 122 apply a force to start the set of switches 112, the limiting piece 124 rotates relative to the rotating shaft 121 in a first direction S1. When the two actuators 122 removes the force W from the set of switches 112, the limiting piece 124 contacts the stopping plate 114 and is restricted to rotate relative to the rotating shaft 121 in a second direction S2 inverse to the first direction S1.

Refer to FIGS. 2A and 2B. The key preloading structure 100 may further include a detachable component 115, such as a screw or other component, configured to temporarily fix the limiting piece 124 on the stopping plate 114, wherein the detachable component 115 is detached after the set of keys 120 is assembled on the base 110. Therefore, during the assembly process, the limiting piece 124 is positioned and cannot rotate in the first direction 51 or the second direction S2, such that the two actuators 122 and the set of switches 112 remain to be in contact with each other and will not generate extra clearance. Then, the detachable component 115 is detached after the assembly of the set of keys 120 is completed.

In an embodiment, the detachable component 115 can pass through the bottom of the base 110 to enter the hole 116 to temporarily fix the limiting piece 124 on the stopping plate 114. The detachable component 115 can be realized by a screw or an insertion piece. In the present embodiment, the detachable component 115 does not have to pass through the bottom of the base 110 to enter the hole 116, that is, the detachable component 115 can enter the hole 116 from other angle or position.

Figure 3:
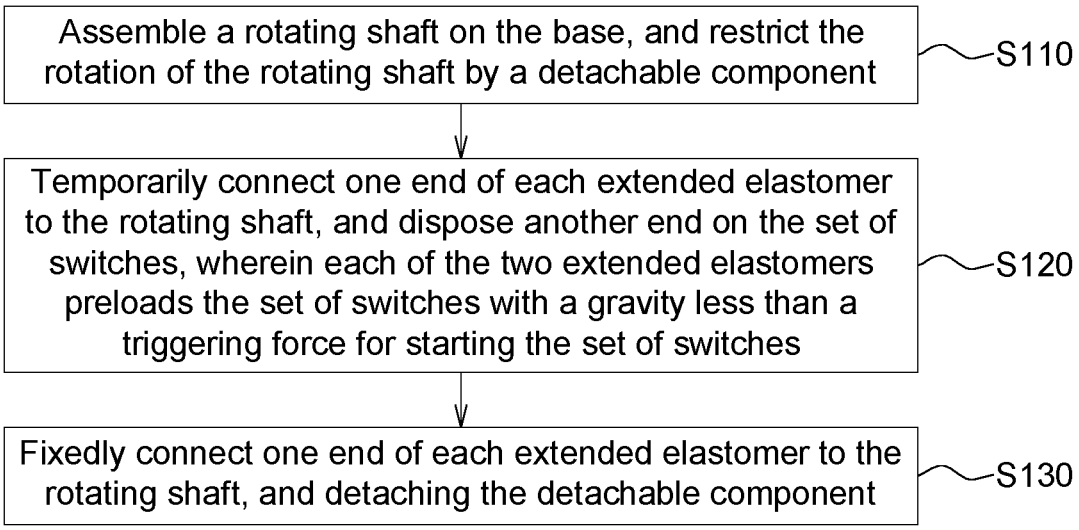
FIG. 3 is a schematic diagram of a key assembly method according to an embodiment of the present invention.

Refer to FIGS. 2A, 2B and 3. FIG. 3 is a schematic diagram of a key assembly method according to an embodiment of the present invention. The key assembly method for assembling the set of keys 120 on the base 110 includes steps S110-S130. In step S110, the rotating shaft 121 is assembled on the base 110, and the rotation of the rotating shaft 121 is restricted by a detachable component 115. In step S120, one end of each actuator 122 is temporarily connected to the rotating shaft 121, and another end is disposed on the set of switches 112, wherein each of the two extended actuators 122 preloads the set of switches 112 with a force W less than a triggering force for starting the set of switches 112. That is, during the assembly process, the two actuators 122 can be positioned when the limiting piece 124 and the stopping plate 114 contact each other, such that the two actuators 122 and the set of switches 112 remain to be in contact with each other and will not generate extra clearance.

In step S130, one end of each actuator 122 is fixedly connected to the rotating shaft 121, and the detachable component 115 is detached. That is, during the assembly process, firstly, the two ends of the rotating shaft 121 are mounted in the two shaft sleeves 125 of the actuator 122; then, a locking member 127, such as a screw rod, passes through each of the shaft sleeves 125 to fix the shaft sleeves 125 on the rotating shaft 121.

According to a key preloading structure and an assembly method thereof disclosed in above embodiments of the present invention, the set of keys preloads the set of switches with a force less than a triggering force, such that during the assembly process, the set of keys and the set of switches remain to be in contact with each other and will not generate extra clearance, hence resolving the problem of virtual press which may easily arise during the process when pressing the keys. Therefore, the key preloading structure and the assembly method thereof of the present invention can improve the user's pressed feel of the key, and further can easily start the key. That is, the pressing force for starting the key (the pressing force +the preloaded force the triggering force) is relatively decreased, and the user will be less burdened with key pressing over a long duration of use.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A key preloading structure, comprising:

a base;

a set of switches including two switches arranged on the base; and a set of keys having a rotating shaft and two actuators, wherein the rotating shaft is assembled on the base, one end of each actuator is fixedly connected to the rotating shaft, another end of each actuator is disposed on a switch of the set of switches each of the two actuators preloads the two switches of the set of switches with a force less than a triggering force for actuating the set of switches, wherein the rotating shaft has a limiting piece facing the base, and when the limiting piece and a stopping plate of the base contact each other, the two actuators preload the two switches of the set of switches with the force.

2. The key preloading structure according to claim 1, wherein the set of switches comprises a set of force sensing elements or a set of thin-film switch elements, respectively configured for generating a pressing signal.

3. The key preloading structure according to claim 1, wherein each end of the two actuators connected to the rotating shaft has a shaft sleeve in which the rotating shaft is mounted.

4. The key preloading structure according to claim 3, wherein the two shaft sleeves respectively comprise a locking member configured to fix each of the shaft sleeves on the rotating shaft.

5. The key preloading structure according to claim 1, wherein each of the two actuators has a protrusion facing and correspondingly contacting one of the switches of the set of switches.

6. The key preloading structure according to claim 1, wherein when the two actuators apply the triggering force on the two switches of the set of switches and actuate the set of switches, the limiting piece rotates relative to the rotating shaft in a first direction; when the two actuators remove the triggering force from the two switches of the set of switches, the limiting piece contacts the stopping plate and is restricted to rotate relative to the rotating shaft in a second direction inverse to the first direction.

7. The key preloading structure according to claim 1, further comprising a housing disposed opposite to the base, wherein the housing has an opening in which the two actuators are arranged.

8. The key preloading structure according to claim 1, further comprising a detachable component configured to temporarily fix the limiting piece on the stopping plate, wherein the detachable component is detached after the set of keys is assembled on the base.

9. The key preloading structure according to claim 8, wherein the detachable component is a screw or an insertion piece passing through the base.

10. A key assembly method used in a key preloading structure comprising a base, a set of switches including two switch and a set of keys, wherein the set of keys has a rotating shaft and two actuators, and the key assembly method comprises:

assembling the rotating shaft on the base, and restricting the rotation of the rotating shaft by a detachable component;

temporarily connecting one end of each actuator to the rotating shaft, and disposing another end of each actuator on the set of switches, wherein each of the two actuators preloads the two switches of the set of switches with a force less than a triggering force for actuating the set of switches; and fixedly connecting one end of each actuator to the rotating shaft, and detaching the detachable component.

* * * * *